US007797762B2

(12) United States Patent
Shapiro et al.

(10) Patent No.: US 7,797,762 B2
(45) Date of Patent: Sep. 21, 2010

(54) CUFF CLIP RELEASABLY ATTACHING SHOE AND GARMENT

(76) Inventors: Howard Shapiro, 1564 S. Beverly Dr., #10, Los Angeles, CA (US) 90035; Ralph Farias, 17418 Covello St., Van Nuys, CA (US) 91406; George Fry, 6243 Crestwood Way, Los Angeles, CA (US) 90042

( * ) Notice: Subject to any disclaimer, the term of this patent is extended or adjusted under 35 U.S.C. 154(b) by 302 days.

(21) Appl. No.: 11/446,841

(22) Filed: Jun. 5, 2006

(65) Prior Publication Data

US 2007/0277290 A1 Dec. 6, 2007

(51) Int. Cl.
*A43B 23/24* (2006.01)
*A41D 13/02* (2006.01)

(52) U.S. Cl. ..... 2/232; 2/231; 2/245

(58) Field of Classification Search ..... 2/23, 2/61, 231, 233, 232, 309, 312, 244, 245
See application file for complete search history.

(56) References Cited

U.S. PATENT DOCUMENTS

| | | | | | |
|---|---|---|---|---|---|
| 176,292 | A | * | 4/1876 | Gardner | 2/232 |
| 198,460 | A | * | 12/1877 | Hoffmann | 2/232 |
| 229,031 | A | | 6/1880 | Campbell | |
| 241,101 | A | * | 5/1881 | Watson | 36/70 R |
| 257,036 | A | * | 4/1882 | McDermott | 36/70 R |
| 271,891 | A | * | 2/1883 | McDermott | 24/316 |
| 387,518 | A | * | 8/1888 | Kauffman et al. | 2/232 |
| 397,703 | A | * | 2/1889 | Diamond et al. | 36/70 R |
| 397,704 | A | * | 2/1889 | Diamond et al. | 36/70 R |
| 450,809 | A | * | 4/1891 | Hicks | 36/70 R |
| 485,807 | A | * | 11/1892 | Aaronson | 2/232 |
| 586,666 | A | | 7/1897 | Neuendorff | |
| 660,670 | A | * | 10/1900 | Tripp | 24/72.1 |
| 668,051 | A | | 6/1901 | Puffer | |
| 703,579 | A | * | 7/1902 | Hardy | 24/72.1 |
| 771,021 | A | | 9/1904 | Lux | |
| 835,343 | A | * | 11/1906 | Andrew | 2/300 |
| 898,200 | A | * | 9/1908 | Elzas | 2/232 |
| 898,503 | A | | 9/1908 | Plummer | |
| 927,017 | A | * | 7/1909 | Young | 36/70 R |
| 1,005,401 | A | * | 10/1911 | Young | 36/70 R |
| 1,242,923 | A | * | 10/1917 | Collings | 36/70 R |
| 1,651,775 | A | * | 12/1927 | Knapp | 2/232 |
| 1,854,532 | A | * | 4/1932 | Valente et al. | 2/232 |
| 2,438,280 | A | * | 3/1948 | Gailey | 36/55 |
| 2,525,756 | A | * | 10/1950 | Aines | 2/232 |
| 2,596,112 | A | * | 5/1952 | Aines | 2/232 |
| 2,848,825 | A | * | 8/1958 | Dollar | 36/1 |
| 2,983,926 | A | * | 5/1961 | Turner | 2/232 |
| 3,137,863 | A | * | 6/1964 | Dimpfl | 2/232 |
| 3,200,414 | A | * | 8/1965 | Sternberg | 2/232 |
| 3,312,982 | A | * | 4/1967 | Pitman | 2/232 |

(Continued)

*Primary Examiner*—Alissa L Hoey
(74) *Attorney, Agent, or Firm*—Cahill Glazer PLC

(57) ABSTRACT

A cuff clip secures a loose trouser leg to a shoe, and support the lower edge of such trouser leg above the ground. A fastener is embedded within a lower portion of the shoe, leaving a coupling head exposed outside the shoe. The cuff clip engages the bottom edge of the trouser leg. The cuff clip includes a snap coupler that mates with the coupling head of the fastener embedded within the shoe. An outwardly-directed exterior wall of the cuff clip includes a bottom lip and opposing side lips to releasably receive a rectangular logo.

4 Claims, 5 Drawing Sheets

U.S. PATENT DOCUMENTS 3,758,890 A * 9/1973 Selzer ..... 2/232
3,839,739 A * 10/1974 Engel ..... 2/232
4,115,906 A 9/1978 Lavine et al.
4,941,213 A * 7/1990 Grilliot et al. ..... 2/312
5,214,805 A * 6/1993 Cochran ..... 2/232
5,542,156 A 8/1996 Oglesby
5,974,591 A 11/1999 Leslie
6,618,862 B1 9/2003 Bunjes
6,701,582 B1 3/2004 Milburn
6,829,847 B2 12/2004 O'Shea et al.
7,032,275 B2 * 4/2006 Nelson et al. ..... 24/72.1
D536,516 S * 2/2007 Sanders ..... D2/946
7,237,306 B1 * 7/2007 Flowers et al. ..... 24/72.1
7,272,862 B1 * 9/2007 Ellington ..... 2/232
7,404,215 B2 * 7/2008 Allen ..... 2/232
2004/0049948 A1 * 3/2004 O'Shea et al. ..... 36/70 R
2004/0200041 A1 * 10/2004 Nelson et al. ..... 24/72.1
2005/0235522 A1 * 10/2005 Crowley et al. ..... 36/2 R
2006/0010661 A1 * 1/2006 Murphy ..... 24/545
2006/0026990 A1 * 2/2006 Carter ..... 63/14.5
2006/0150301 A1 * 7/2006 Mehren et al. ..... 2/232
2006/0174389 A1 * 8/2006 Engel ..... 2/46
2006/0213036 A1 * 9/2006 Flowers et al. ..... 24/72.1
2007/0192998 A1 * 8/2007 Ryder ..... 24/1
2007/0277292 A1 * 12/2007 Lambert et al. ..... 2/244
2008/0115259 A1 * 5/2008 Wells ..... 2/232

* cited by examiner

CUFF CLIP RELEASABLY ATTACHING SHOE AND GARMENT

BACKGROUND OF THE INVENTION

1. Field of the Invention

The present invention relates generally to garments and outer wear wherein a loose fitting or extended length leg covering extends down to or below the upper ankle, and more particularly, to an accessory for preventing a pant leg from dragging on the ground.

2. Description of the Related Art

A recent trend in the fashion clothing industry is to make lower body coverings, notably pant legs, exceptionally long and wide. Reminiscent of bell-bottomed pants, fashion pants styles being sold today include pant legs that are exceptionally large in circumference and which extend below the upper ankle to the foot. In some cases, the bottoms of such pant legs may extend beyond the bottom of the foot so as to drag on the ground as the wearer walks. This poses several practical drawbacks, including the hazards of tripping, catching the garment on an object, soiling, as well as premature wear generated by contact with the ground as the wearer walks or moves.

In the past, others have proposed the use of a variety of trouser retention devices. For example, U.S. Pat. No. 229,031 to Campbell discloses a cuff protector secured to the bottom of a trouser leg by pins to protect the trouser from being soiled or worn through contact with the ground. While Campbell's device protects the bottom hem of the pant leg to some degree, the garment remains free to move independently of the shoe. Moreover, this device requires that the garment be pierced by a pair of pins.

In U.S. Pat. No. 668,051 to Puffer, a trousers protector includes a clip that is used to catch the bottom edge of an extending trouser leg, and to attach it to a shoe. Puffer's clip includes a portion that must be inserted inside the wearer's shoe, posing some discomfort to the wearer. Moreover, Puffer's clip positions the lower edge of the pants leg proximate the upper edge of the wearer's shoe. U.S. Pat. No. 771,021 to Lux also discloses a clip to extend around the top of a shoe, but this device must actually be attached to a garment by stitches. All of these devices require a clip to extend over the shoe top, and into the shoe, which poses discomfort to the user, and which position the lower hem of the pant leg elevated well above the ground.

Some known trouser supports allow for adjustment of the elevation of the trouser hem relative to the top of the shoe. For example, U.S. Pat. No. 586,666 to Neuendorff discloses a trouser support clip mechanism that clips over the top of a shoe and which includes a mechanism for varying the length of the clip. U.S. Pat. No. 898,503 to Plummer discloses a trousers support clip using a chain that can be adjusted in length to vary the height at which the lower hem of the pant leg is supported. However, like the other double-clip devices discussed above, the Neuendorff and Plummer trouser retention devices still include the requirement for extending over and around the shoe top, extending behind, and in contact with, the wearer's heel.

U.S. Pat. No. 6,618,862 to Bunjes also discloses a double-clip pant leg support wherein a portion of the clip must be inserted inside the shoe. The Bunjes device is designed to support the lower hem relatively low to the ground. While the Bunjes device is made from flexible materials, the clip must still be inserted inside the compartment of the shoe that receives the wearer's foot.

Other devices are also known to attach pant cuffs to shoes. For example, U.S. Pat. No. 4,115,906 to Lavine discloses a pair of releasable clips attached to opposite ends of an elongated elastic strap. The strap is extended around the bottom of the shoe, and the clips are attached to opposite sides of the lower hem of the pants leg. Lavine's device secures a trouser cuff simply by pulling it down toward the wearer's shoe. Such a strap will not, however, prevent an extending trouser leg from brushing on the ground.

U.S. Pat. No. 5,542,156 to Ogelsby also discloses a strap used to pull trouser legs down toward the wearer's shoes. Oglesby discloses the use of a snap fastener for attaching the strap to the pant leg. These snap fasteners can be attached either to the interior or the exterior of the trouser leg, and are a semi permanent fixture to the pant leg.

U.S. Pat. No. 6,701,582 Milburn discloses a trouser leg retaining device that prevents the bottom of the trouser leg from getting caught within the user's shoes. This device includes a strap to connect the shoe directly to the pant leg. One end of the strap includes an O-ring or clip for attachment to the shoe. The trouser leg portion fastens via a snap fastener through the garment material of the pant leg, requiring the piercing of the material to fasten the snap.

U.S. Pat. No. 6,829,847 to O'Shea discloses a pant cuff protector for securing a pant leg to a shoe via the use of magnetic clamps. A first magnet is secured to the rear of a shoe. A second magnet is secured to a strap extending from the lower heel portion of the shoe. The second magnet is selectively positioned proximate the first magnet to clamp a pant cuff therebetween.

U.S. Pat. No. 5,974,591 to Leslie discloses a strap for securing a firefighter's trousers to his boots. The strap is attached to the top of the boot barrel. A snap is provided on the pant leg to snap onto the lower end of the strap.

None of the aforementioned trouser retention devices serves both to prevent contact of the pants leg with the ground, while avoiding the need to either insert a clip into the inner portion of the shoe or substantially modify the shoe. Furthermore, typical retention devices do not provide for the placement of a logo, or other indicia, on the outer surface, nor do they allow for convenient replacement of such a logo.

Accordingly, it is an object of the present invention to provide a cuff clip that easily and conveniently serves to prevent the lower hem of a pant leg from becoming soiled or worn through contact with the ground.

It is another object of the present invention to provide a cuff clip that does not require any augmentation or damage to the pant leg material.

It is still another object of the present invention to provide for a strong and semi-permanent shoe portion attachment together with a separate cuff clip member that can be easily secured or removed as the wearer sees fit.

It is yet another object of this invention to provide for a semi-permanent attachment that can be installed on multiple shoes, each with a complimentary head fastener piece that can combine with a variety of cuff clips.

A further object of the present invention is to provide such a cuff clip that is easy and inexpensive to manufacture.

A still further object of the present invention is to provide such a cuff clip adapted to display one or more logos.

These and other objects of the present invention will become more apparent to those skilled in the art as the description of the present invention proceeds.

SUMMARY OF THE INVENTION

Briefly described, and in accordance with a preferred embodiment thereof, the present invention relates to an apparatus for supporting the lower end of a pant leg from a shoe. A U-shaped body includes first and second panels extending substantially parallel to each other and spaced apart from each other. The first and second panels include interior and exterior walls; the interior walls of the first and second panels generally face each other and form an inner volume space therebetween for receiving the lower end of a pant leg. A first fastener is secured to the rear portion of a shoe proximate the heel portion thereof. A second fastener is secured to the exterior wall of the first panel of the U-shaped body. The second fastener releasably mates with the first fastener for selectively supporting the U-shaped body from the rear portion of the shoe proximate the heel of the shoe. Preferably, logo indicia is displayed upon the exterior wall of the second panel of the U-shaped body.

In one preferred embodiment, a cuff clip includes a shoe member attached to the lower, rear portion of a shoe and including a first coupling member. The cuff clip also includes a cuff support member for receiving, and releasably supporting, the lower end of a pant leg. The cuff support member includes a second coupling member adapted to releasably engage the first coupling member, thereby releasably coupling the cuff support member to the shoe member to supports the lower end of the pant leg from the lower, rear portion of the shoe.

In one preferred embodiment, the first coupling member may be in the form of an elongated fastener extending partially into, and secured within, a heel portion of the shoe. The portion of the elongated fastener that extends into the heel preferably includes an irregular outer surface for anchoring the elongated fastener within the heel of the shoe. In a preferred embodiment, the first coupling member includes a female hollow socket, while the second coupling member includes a complimentary male stud adapted to releasably engage the female hollow socket and form a snap fit therewith. In an alternate embodiment, the first coupling member includes a male stud, and the second coupling member includes a complimentary female hollow socket adapted to releasably receive the male stud.

The aforementioned cuff support member preferably includes a U-shaped body including first and second panels extending substantially parallel to each other and spaced apart from each other to form a channel for receiving the lower end of the pant leg. The second coupling member is preferably secured to the exterior wall of the first panel, while the exterior wall of the second panel may be used to display logo indicia. In one preferred embodiment, the exterior wall of the second panel includes a bottom lip extending at least partially along a lower end of the exterior wall of the second panel, as well as first and second side lips extending at least partially along opposing sides of the exterior wall of the second panel. The bottom lip and opposing side lips may be used to releasably retain a generally planar logo element upon the exterior wall of the second panel.

In still another preferred embodiment, the cuff clip includes an anchor portion that is fixedly secured to the heel portion of a shoe, as by being molded into the rear portion of the sole of the shoe. In this embodiment, it is not necessary to provide any releasable coupling between the cuff clip and a fastener within the shoe. If desired, the coupling between the anchor and the cuff clip may be detachable for allowing the cuff clip to be released from the anchor when not in use.

Another aspect of the present invention relates to a method of releasably attaching the lower edge of a garment to a shoe. In practicing such method, a first coupler is installed within the lower portion of a shoe. A cuff clip is provided for releasably engaging the lower edge of the garment. The lower edge of the garment is inserted into the cuff clip. A second coupler is provided on the cuff clip, the second coupler being complementary with the first coupler for being releasably engaged therewith. The second coupler is engaged with the first coupler for releasably attaching the lower edge of the garment to the lower portion of the shoe. In one preferred embodiment of such method, an elongated fastener is provided to form the first coupler. At least the first end of the elongated fastener is secured within a heel portion of the shoe, while the second end of the elongated fastener is used as the first coupler.

In practicing an alternate embodiment of such method, the cuff clip includes an anchor portion, and the method includes forming the rear portion of the sole of the shoe around the anchor portion of the cuff clip during manufacture of the shoe, thereby fixedly securing the cuff clip to the heel portion of the shoe. The lower edge of the garment is simply inserted into the cuff clip.

In practicing the aforementioned method, the cuff clip is preferably formed by providing first and second substantially parallel, spaced-apart panels, and joining the lower edges of the first and second panels to form a generally U-shaped body. Interior walls of the first and second panels form an inner space, or channel, for receiving the lower edge of the garment. Preferably, the second coupler is secured to an exterior wall of the first panel, while the exterior wall of the second panel is used to display indicia, such as a logo. In the preferred embodiment, the indicia to be displayed is generally planar; a bottom lip is formed along a lower end of the exterior wall of the second panel, and opposing side lips are formed along opposing sides of the exterior wall of the second panel. The indicia to be displayed is engaged with, and retained by, the bottom lip and opposing side lips for being displayed from the exterior wall of the second panel of the cuff clip.

DETAILED DESCRIPTION OF THE PREFERRED EMBODIMENTS

Figure 1:
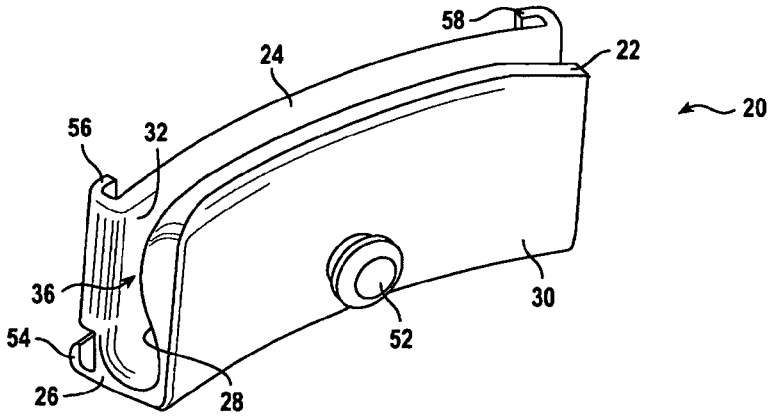
FIG. 1 is a perspective view of a cuff clip constructed in accordance with a preferred embodiment of the present invention.
Figure 2:
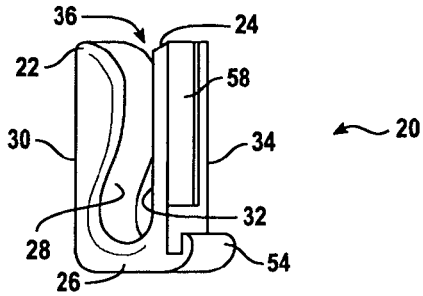
FIG. 2 is a side view of the cuff clip shown in FIG. 1.
Figure 3:
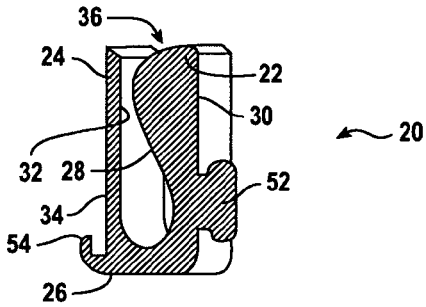
FIG. 3 is a cross sectional view of the cuff clip shown in FIG. 1 viewed from the opposite side as that shown in FIG. 2.
Figure 4:
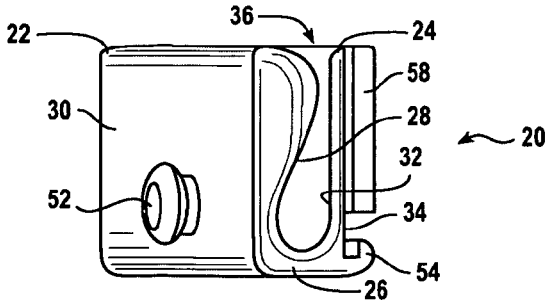
FIG. 4 is an angled view of the cuff clip shown in FIG. 1
Figure 5:
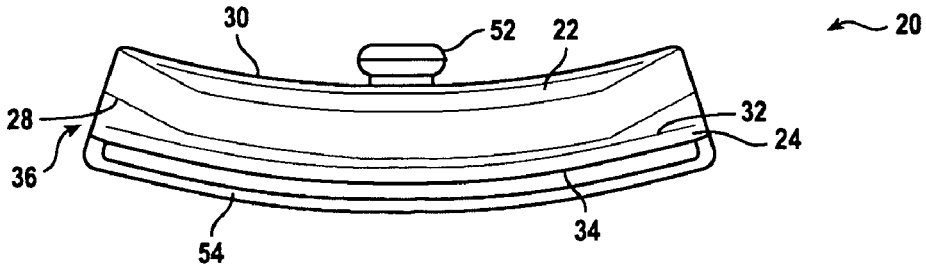
FIG. 5 is a top view of the cuff clip shown in FIG. 1.
Figure 6:
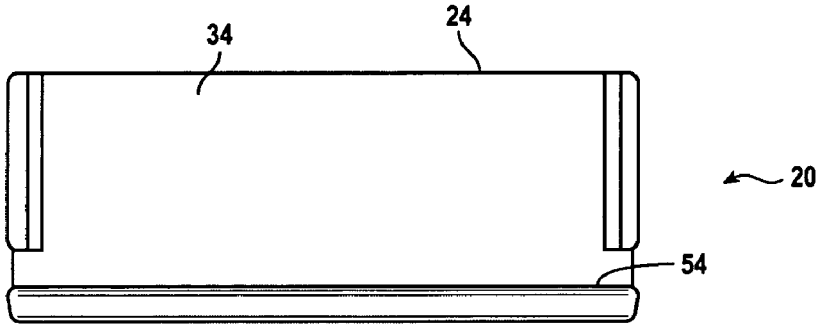
FIG. 6 is a frontal view of the cuff clip shown in FIG. 1 and showing three lips that may be used to secure display indicia upon an exterior wall thereof.
Figure 7:
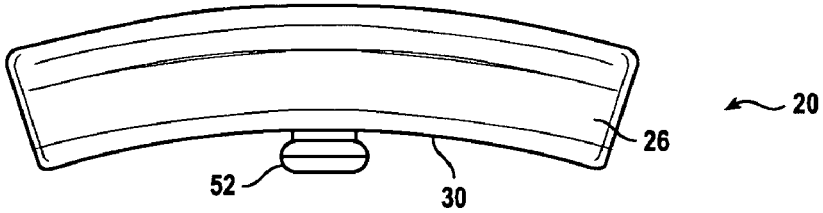
FIG. 7 is a bottom view of the cuff clip shown in FIG. 1.

A cuff clip for supporting the lower end of a pant leg from a shoe, and constructed in accordance with a preferred embodiment of the present invention, is shown in FIG. 1 and is designated generally by reference numeral 20. Referring generally to FIGS. 1-7, cuff clip 20 is preferably formed as a U-shaped body including a first panel 22 and a second panel 24 extending substantially parallel to first panel 22. As shown in FIGS. 1-4, and in the bottom view of FIG. 7, the lower edges of panels 22 and 24 are joined to each other by bottom wall 26 to form a generally U-shaped body. Also, as shown best in the top view of FIG. 5 and the bottom view of FIG. 6, panels 22 and 24 may be bowed along their length to form a slightly arcuate structure that more closely adapts to the rounded rear peripheral portion of a shoe heel.

Still referring to FIGS. 1-7, first panel 22 includes an interior wall 28 and an exterior wall 30. As best illustrated in the sectional drawing of FIG. 3, interior wall 28 of first panel 22 is not precisely flat; rather, first panel 22 is thicker proximate its top edge than proximate its lower edge. Second panel 24 also includes an interior wall 32 and an exterior wall 34. Interior walls 28 and 32 of first and second panels 22 and 24 generally face each other and are spaced slightly apart from each other to form an inner space, or channel 36 therebetween. As mentioned above, interior wall 28 preferably has a cross-sectional contour, and is shaped to cause channel 36 to have a narrow opening towards the top, gradually opening into a wider space towards the bottom; this preferred shape of channel 36 provides space to receive a relatively thick hem at the bottom of the channel, while maintaining a tight grip on the garment edge at the top of the clip. Channel 36 is arcuately curved along its length, following the curvature of panels 22 and 24. Channel 36 is adapted to releasably receive the lower end of a pant leg, cuff, or the lower edge of another garment (not shown). Cuff clip 20 is sometimes referred to herein as a cuff support member since it can be used to support the cuff of a pant leg.

Figure 8:
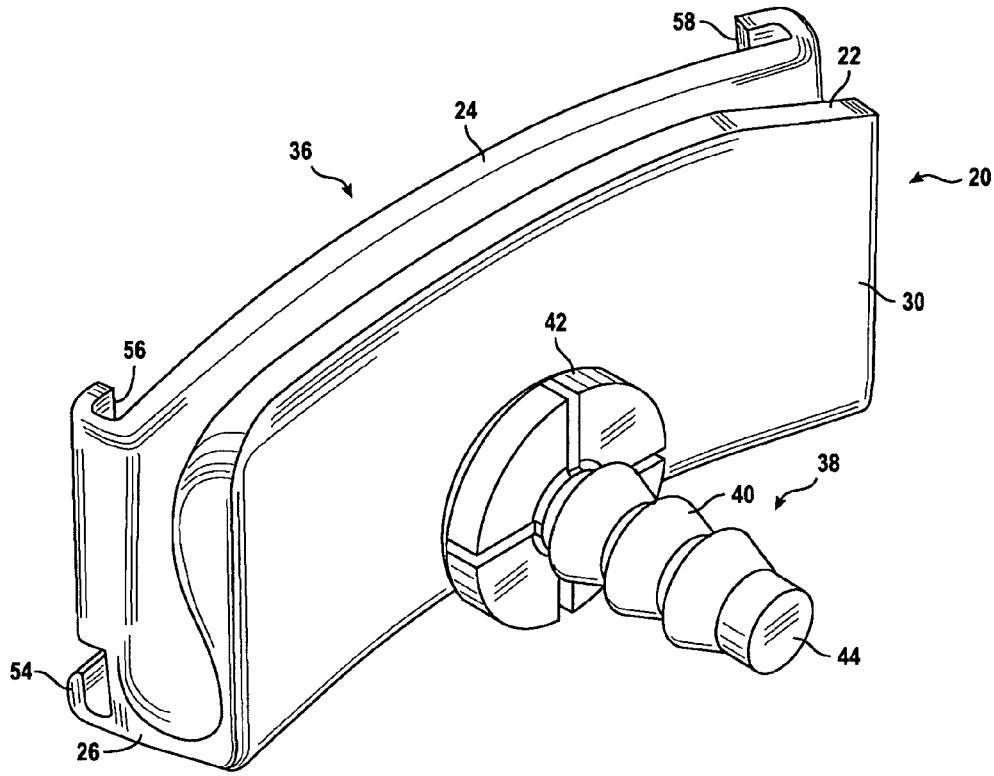
FIG. 8 is a perspective view of the cuff clip of FIG. 1 mated with the head of a fastener used to releasably attach the cuff clip to the heel portion of a shoe.
Figure 12:
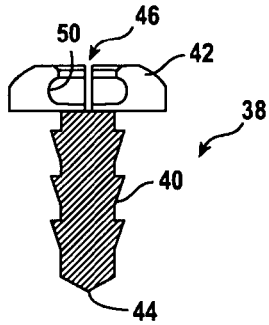
FIG. 12 is a cross-sectional side view of the fastener shown in FIG. 8 illustrating slots for receiving a screw driver, as well as the hollow socket for mating with the rear stud of the cuff clip.
Figure 13:
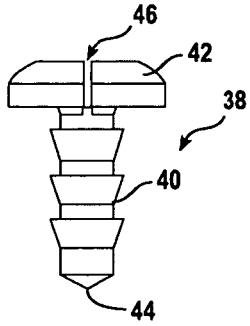
FIG. 13 is a side view of the fastener shown in FIGS. 8 and 12.

Referring briefly to FIG. 8, a first fastener 38 is shown releasably secured to exterior wall 30 of cuff clip 20. In the embodiment illustrated in FIG. 8, fastener 38 is in the form of a nail having a barbed shaft 40 and an attachment head 42. As indicated in FIGS. 12 and 13, the end 44 of shaft 40 forms a sharp, tapered point to assist in puncturing the heel portion of a shoe, or alternatively, to help guide fastener 38 into a preformed bore hole in the heel of the shoe. Fastener 38 is adapted to be secured inside the heel portion of a shoe, preferably by drilling, or otherwise forming, a bore extending into the shoe heel having a diameter slightly less than the outer diameter of the barbed ridges on shaft 40. After forming such bore, pointed end 44 of fastener 38 is directed into such bore, and fastener 38 is then urged further into the bore. The barbed ridges on shaft 40 prevent fastener 38 from falling out of the shoe heel after being secured thereto. Accordingly, fastener 38 is sometimes referred to herein as a shoe member since it is adapted to be secured to the lower, rear portion of a shoe, e.g., the heel.

Figure 14:
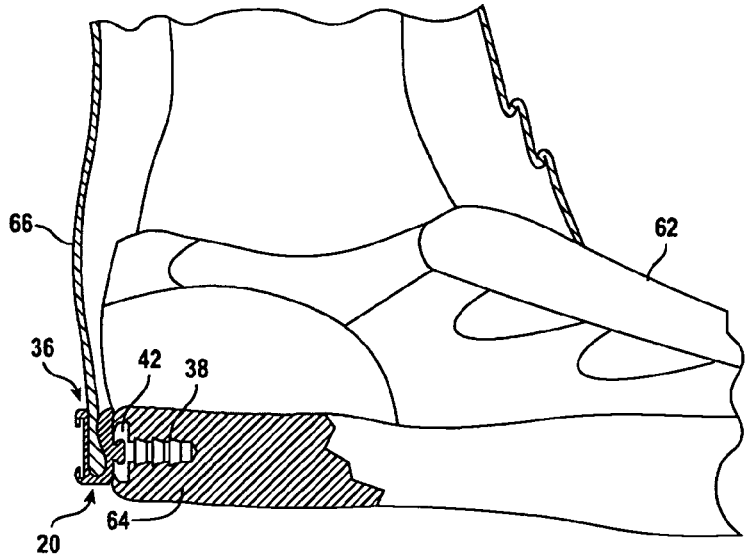
FIG. 14 is a partial sectional view of the heel portion of a shoe, with the cuff clip apparatus installed for supporting the lower hem of a pant leg from the shoe.
Figure 15:
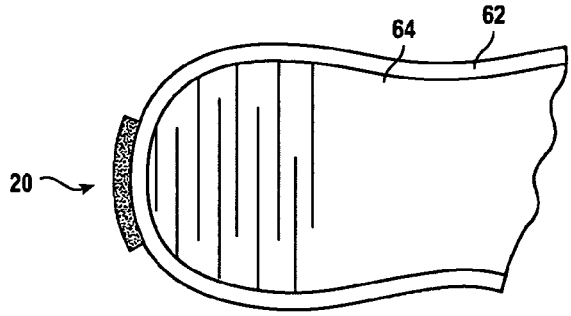
FIG. 15 is a bottom view of the shoe and cuff clip apparatus shown in FIG. 14.

Referring briefly to FIG. 14, shoe 62 includes a sole having a heel portion 64. Fastener 38 is secured within heel portion 64 of the sole, preferably from the rear of shoe 62. Preferably, attachment head 42 is recessed within heel portion 64, as shown in FIG. 14; this allows cuff clip 20 to abut the rear of shoe 62 and conform to the curvature of the rear portion of shoe 62, as shown in FIG. 15. Alternatively, if desired, attachment head 42 can protrude slightly from heel portion 64. Cuff clip 20 is releasably secured to attachment head 42 of fastener 38, and the lower hem of pant leg 66 is releasably engaged within channel 36 of cuff clip 20.

Figure 10:
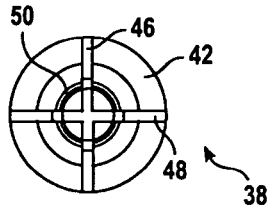
FIG. 10 is a top view of the fastener shown in FIG. 8, illustrating that the head of such fastener includes slots for receiving a screw driver, as well as a hollow socket for mating with a rear stud of the cuff clip.
Figure 11:
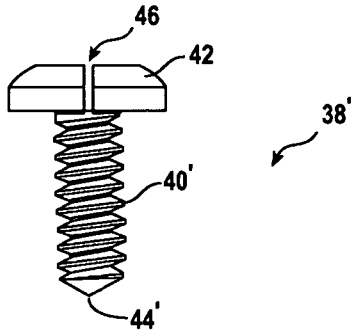
FIG. 11 is a side view of an alternate embodiment of the fastener including a threaded shaft.

FIG. 11 shows an alternate embodiment of the first fastener, designated as 38', wherein shaft 40' has a helical screw thread formed about its periphery for approximately five-eighths of an inch of axial length, rather than barbs. In either case, shaft 40 preferably has an irregular outer surface for anchoring fastener 38 to the heel of the shoe. As indicated in FIGS. 10 and 12, attachment head 42' may include a first slot 46 for receiving the blade of a conventional flat-bladed screwdriver for use in screwing fastener 38' into a bore formed in the heel of shoe. If desired, a second slot 48 (see FIG. 10) may be formed in attachment head 42, perpendicular to first slot 46, for receiving the blade of a Phillips-head screwdriver.

As shown best in FIGS. 10 and 12, attachment head 42 of fastener 38 has a hollow socket 50 formed therein and adapted to releasably receive a rounded stud. While fasteners 38 and 38' may be made of a wide variety of materials, including metal, fasteners 38 and 38' are preferably formed of molded plastic to minimize manufacturing expense.

Referring again to FIGS. 1-7, a second fastener, in the form of a rounded male stud 52, is secured to, and extends from, exterior wall 30 of first panel 22 of the U-shaped cuff clip 20. Rounded stud 52 is of a size and configuration to releasably mate with, and be received within, hollow socket 50 of attachment head 42 for selectively supporting cuff clip 20 from the rear portion of a shoe (not shown), proximate the heel thereof. It should be noted that attachment head 42 and rounded stud 52 are sometimes referred to herein as coupling members since they are adapted to be releasably coupled with each other. Attachment head 42 and stud 52 form a snap-type fastener for releasably securing the cuff support member from the lower, rear portion of a shoe. Rounded stud 52 is preferably integral with exterior wall 30 of first panel 22. In the preferred embodiment, cuff clip 20 is molded from a plastic material as an integral structure.

Those skilled in the art will appreciate that the locations of socket 50 and stud 52 could be reversed, if desired, by forming a rounded stud on attachment head 42 of fastener 38, and by including a hollow socket upon exterior wall 30 of first panel 22.

Figure 16:
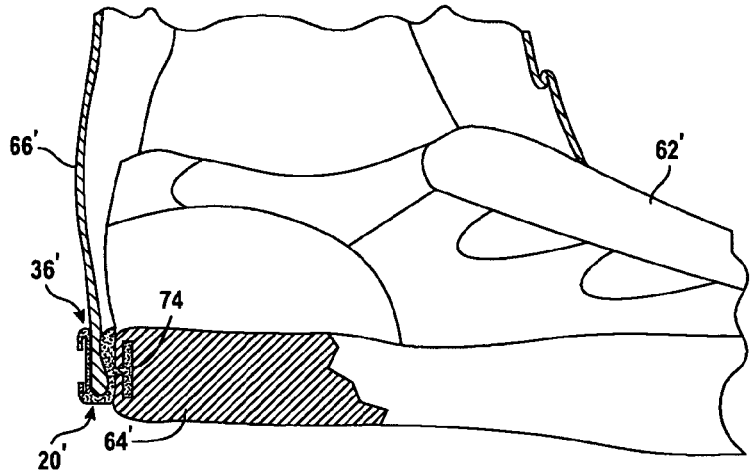
FIG. 16 is a partial sectional view of a shoe formed to incorporate a cuff clip at the time of manufacturing the shoe.

Those skilled in the art will also appreciate that a shoe manufacturer could allow for the support of such a cuff clip at the time that a shoe is being manufactured. In this regard, FIG. 16 illustrates a shoe 62' having a sole that includes heel portion 64'. The sole of shoe 62' is formed of a molded material. Cuff clip 20' is shown in FIG. 16 as including an integral anchor 74; anchor 74 includes an enlarged backing plate coupled by a short stub shaft to the exterior wall of cuff clip 20' that faces shoe 64'. The shoe manufacturer molds the heal portion 64' of the sole around the enlarged backing plate of anchor 74 to secure cuff clip 20' to shoe 62'. While FIG. 16 shows anchor 74 being integral with cuff clip 20', those skilled in the art will appreciate that anchor 74 could instead include an attachment head 42 of the type shown on fastener 38 in FIGS. 10 and 12 for mating with a complementary fastener on cuff clip 20'. While FIG. 16 shows anchor 74 being molded into heel portion 64' of shoe 62', those skilled in the art will appreciate that, if desired, a shoe manufacturer could instead secure anchor 74 to the upper body of the shoe, as by, for example, securing the backing plate of anchor 74 between outer and inner layers of material used to form the upper body of the shoe.

As mentioned above, one of the objects of the invention is to allow logos, or other indicia, to be displayed from cuff clip 20. Exterior wall 34 of second panel 24 is preferably used for this purpose. Such logo or other indicia may be molded into, printed upon, adhered to, or otherwise secured to exterior wall 34 of second panel 24 for being displayed as the user stands or walks. Preferably, lips are formed upon the bottom and side edges of exterior wall 34 for allowing logos or other indicia to be easily interchanged; no lip is formed along the top edge of exterior wall 34 to avoid interfering with the insertion of display indicia. Referring to FIGS. 1-6 and FIG. 8, bottom upturned lip 54 extends along the lower end of exterior wall 34 of second panel 24. A first inwardly-turned side lip 56 extends at least partially along one side of exterior wall 34, while a second inwardly-turned side lip 58 extends at least partially along the opposite side of exterior wall 34. A generally planar indicia element, bearing a logo or the like, may be removably inserted upon the exterior wall of second panel 24 and retained within bottom lip 54 and first and second side lips 56 and 58 .

Figure 9:
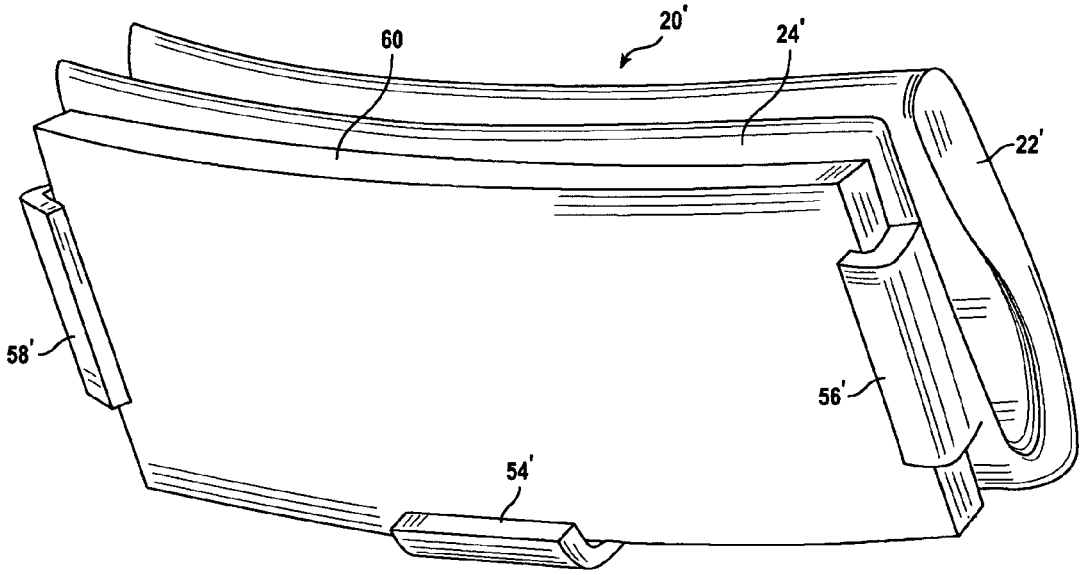
FIG. 9 is a perspective view of the cuff clip of FIG. 1 wherein generally planar display indicia is inserted into, and retained by, the three lips shown in FIG. 6.

The above-described manner of displaying an indicia element upon cuff clip 20 is illustrated in FIG. 9, which shows an alternate embodiment of the cuff clip, and wherein primed reference numerals indicate features already described above using like reference numerals. In FIG. 9, bottom lip 54' extends only along the center portion of the bottom edge of second panel 24', rather than all the way across. Likewise, in FIG. 9, side lips 56' and 58' terminate before reaching the upper end of second panel 24. Within FIG. 9, element 60 represents a generally planar indicia element, bearing a logo or the like, which has been inserted upon the exterior wall of second panel 24' and retained thereon by bottom lip 54' and first and second side lips 56' and 58'.

It will be recalled that another aspect of the present invention relates to an improved method of releasably attaching the lower edge of a garment to a shoe. In practicing such method, a first coupler, e.g., attachment head 42, is secured to the lower portion of a shoe. A cuff clip, e.g., cuff clip 20, is provided to releasably engage the lower edge of a garment. The lower edge of the garment is inserted into the cuff clip, e.g., into channel 36 of cuff clip 20. A second complementary coupler, e.g., rounded stud 52, is provided on the cuff clip to releasably engage the first coupler. The second coupler is engaged with the first coupler for releasably attaching the lower edge of the garment to the lower portion of the shoe. In one preferred embodiment, the first coupler is secured to the lower portion of the shoe by providing an elongated fastener, such as fastener 38, anchoring at least a first end of the elongated fastener into a heel portion of the shoe, and using the opposing second end (e.g., attachment head 42) of the elongated fastener as the first coupler.

In practicing a preferred embodiment of the aforementioned method, the cuff clip is provided by providing first and second panels extending substantially parallel to each other and spaced slightly apart from each other to form an inner space or channel therebetween for receiving the lower edge of the garment. In the preferred embodiment, the second coupler is provided by securing the second coupler to an exterior wall of the first panel. Also in the preferred embodiment of such method, a bottom lip is formed at least partially along a lower end of the exterior wall of the second panel, and first and second side lips are formed at least partially along opposing sides of the exterior wall of the second panel to receive a generally planar indicia element upon the exterior wall of the second panel.

After securing a suitable fastener to the user's shoe, engaging the lower end of a pant leg with the cuff clip, and snapping the cuff clip onto the shoe-mounted fastener, the cuff clip and shoe-mounted fastener work together to maintain a garment edge in a fixed position relative to the shoe.

Those skilled in the art will now appreciate that a cuff clip apparatus has been described which easily and conveniently serves to prevent the lower hem of a pant leg from becoming soiled or worn through contact with the ground. The described cuff clip does not result in any discomfort due to contact between the clip device and the user's foot, as it does not extend within the compartment of the shoe that receives the user's foot. The novel cuff clip does not require any alteration of the pant leg, while requiring only minor modification of a shoe. Should the user so desire, the cuff clip can be released from the shoe fastener to disconnect the lower edge of the pant leg from the shoe. The same cuff clip may be used with two or more pairs of shoes, provided that each pair of shoes includes a complementary fastener of the general type described herein. Alternatively, two or more different cuff clips may be used with the same pair of shoes. The described cuff clip apparatus is easy and inexpensive to manufacture, and can be formed of durable materials. Moreover, the disclosed cuff clip apparatus can advantageously be used to display fixed, or interchangeable, logos or other indicia. While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

We claim:

1. A cuff clip apparatus for use in conjunction with a shoe, the shoe having a sole, and the rear portion of the sole including a heel portion, the cuff clip apparatus comprising:

a. a shoe member attached to the heel portion of the sole of a shoe, the shoe member including a first coupling member, the shoe member further including an elongated fastener extending between first and second opposing ends, the first end of the elongated fastener being secured within a heel portion of the sole of the shoe, and the second end of the elongated fastener extending outwardly from the heel portion of the sole of the shoe to form the first coupling member, wherein the elongated fastener includes a shaft extending between its first and second ends, the shaft having an irregular outer surface for anchoring the elongated fastener within the heel portion of the sole of the shoe; and b. a cuff support member for receiving and releasably supporting the lower end of a pant leg, the cuff support member including a second coupling member for releasably engaging the first coupling member to releasably couple the cuff support member to the shoe member;

whereby the cuff support member releasably supports the lower end of the pant leg from a heel portion of the sole of a shoe.

2. Apparatus for supporting the lower end of a pant leg from a shoe, the shoe having a sole, and the rear portion of the sole including a heel portion, said apparatus comprising:

a. a U-shaped body including a first panel, and including a second panel extending substantially parallel to the first panel, the first and second panels each including an interior wall, the interior walls of the first and second panels generally facing each other and being spaced apart from each other to form an inner volume space therebetween for receiving the lower end of a pant leg, the first and second panels each including an opposing exterior wall;

b. an anchor secured within the heel portion of the sole of the shoe; and c. the anchor being coupled to the exterior wall of the first panel of the U-shaped body for supporting the U-shaped body from the heel portion of the sole of the shoe;

wherein the anchor is releasably coupled to the exterior wall of the first panel of the U-shaped body.

3. A cuff clip apparatus for use in conjunction with a shoe, the shoe including a rear portion, the cuff clip apparatus comprising:

a. a shoe member attached to the rear portion of the shoe, the shoe member including a first coupling member;

b. a cuff support member for receiving and releasably supporting the lower end of a pant leg, the cuff support member including a second coupling member for engaging the first coupling member to couple the cuff support member to the shoe member;

c. the cuff support member including a U-shaped body including a first panel, and including a second panel extending substantially parallel to the first panel, the first and second panels each including an interior wall, the interior walls of the first and second panels generally facing each other and being spaced apart from each other to form an inner volume space therebetween for receiving the lower end of a pant leg, the first and second panels each including an opposing exterior wall, the second coupling member being secured to the exterior wall of the first panel of the U-shaped body, the second coupling member mating with the first coupling member of the shoe member for supporting the U-shaped body proximate the rear portion of the shoe;

d. the exterior wall of the second panel including:

I. a bottom lip extending at least partially along a lower end of the exterior wall of the second panel;

ii. a first side lip extending at least partially along one side of the exterior wall of the second panel; and iii. a second side lip extending at least partially along an opposite side of the exterior wall of the second panel.

e. wherein the cuff support member releasably supports the lower end of the pant leg from a rear portion of a shoe.

4. The cuff clip apparatus recited by claim 3 further including a generally planar logo element removably inserted upon the exterior wall of the second panel and retained within the bottom lip and first and second side lips.

* * * * *